US010342074B2

(12) United States Patent
Geren et al.

(10) Patent No.: US 10,342,074 B2
(45) Date of Patent: Jul. 2, 2019

(54) DISTRIBUTED TRANSISTOR-BASED POWER SUPPLY FOR SUPPLYING HEAT TO A STRUCTURE

(71) Applicant: The Boeing Company, Chicago, IL (US)

(72) Inventors: William Preston Geren, Shoreline, WA (US); Stephen Moore, Renton, WA (US); Robert J. Miller, Fall City, WA (US); Mark Negley, Bellvue, WA (US); Scott D. Billings, Des Moines, WA (US)

(73) Assignee: THE BOEING COMPANY, Chicago, IL (US)

( * ) Notice: Subject to any disclaimer, the term of this patent is extended or adjusted under 35 U.S.C. 154(b) by 937 days.

(21) Appl. No.: 13/733,930

(22) Filed: Jan. 4, 2013

(65) Prior Publication Data

US 2014/0190954 A1 Jul. 10, 2014

(51) Int. Cl.

| | |
|---|---|
| ***H05B 6/04*** | (2006.01) |
| ***H05B 6/06*** | (2006.01) |
| ***H05B 6/24*** | (2006.01) |
| ***H05B 6/10*** | (2006.01) |

(52) U.S. Cl.

CPC ..... *H05B 6/105* (2013.01); *H05B 6/06* (2013.01); *H05B 2206/023* (2013.01)

(58) Field of Classification Search

CPC .... H01L 21/67248; B64D 15/12; F24C 7/082
USPC ..... 219/482–506, 201, 528, 545
See application file for complete search history.

(56) References Cited

U.S. PATENT DOCUMENTS

| | | | | |
|---|---|---|---|---|
| 4,271,350 A * | 6/1981 | Crowley | ..... | H05B 3/56 174/106 SC |
| 6,163,907 A * | 12/2000 | Larson | ..... | A47C 31/105 5/421 |
| 2004/0069769 A1* | 4/2004 | Carr | ..... | G05D 23/2401 219/497 |
| 2006/0076338 A1* | 4/2006 | Kagan | ..... | H05B 6/04 219/201 |

FOREIGN PATENT DOCUMENTS

| | | |
|---|---|---|
| EP | 2209197 A1 | 7/2010 |
| EP | 2306784 A1 | 4/2011 |
| WO | 9522237 A1 | 8/1995 |
| WO | 2012020652 A1 | 2/2012 |

OTHER PUBLICATIONS

International Search Report and Written Opinion dated Jan. 29, 2014, 11 pages.

* cited by examiner

*Primary Examiner* — Tu B Hoang
*Assistant Examiner* — Thomas J Ward
(74) *Attorney, Agent, or Firm* — Patterson + Sheridan, LLP

(57) ABSTRACT

A heating system includes a structure to be heated, and a heating apparatus disposed to heat the structure. The heating apparatus includes a housing member, a plurality of resonant frequency power sources, and a plurality of associated controls. The plurality of resonant frequency power sources are attached to the housing member. The plurality of associated controllers is configured to separately operate the plurality of resonant frequency power sources at resonant frequencies matching heating requirements of the structure.

24 Claims, 4 Drawing Sheets

DISTRIBUTED TRANSISTOR-BASED POWER SUPPLY FOR SUPPLYING HEAT TO A STRUCTURE

FIELD OF THE DISCLOSURE

This disclosure relates to a distributed transistor-based power supply for supplying heat to a structure.

BACKGROUND

Many applications require the heating of structures. For instance, during the consolidation or molding of thermoplastics to an airplane, such as during repair in the field of a composite airplane or another type of structure, the thermoplastics may need to be heated. There are issues with many of the existing heating devices used to heat structures. One such issue is that it may be difficult to efficiently drive a large area heating device. Another such issue is that it may be difficult to design a flexible and lightweight heating device suitable for the application at hand, such as repair in the field. Yet another such issue is that some power supplies for heating devices require unacceptably high voltages and cumbersome cabling to drive the heating devices. One or more additional issues can also be experienced with the existing heating devices.

A system and method is needed to reduce one or more issues experienced by one or more of the existing heating devices.

SUMMARY

In one embodiment, a heating apparatus is disclosed. The heating apparatus includes a housing member, a plurality of resonant frequency power sources, and at least one controller. The plurality of resonant frequency power sources are attached to the housing member. The at least one controller is configured to separately operate the plurality of resonant frequency power sources at resonant frequencies in order to control heating temperature.

In another embodiment, a heating system is disclosed. The heating system includes a structure to be heated, and a heating apparatus disposed to heat the structure. The heating apparatus includes a housing member, a plurality of resonant frequency power sources, and a plurality of associated controls. The plurality of resonant frequency power sources are attached to the housing member. The plurality of associated controllers is configured to separately operate the plurality of resonant frequency power sources at resonant frequencies matching heating requirements of the structure.

In still another embodiment, a method for heating a structure is disclosed. In one step, a housing member is placed in a position to heat a structure. In another step, a plurality of resonant frequency power sources attached to the housing member are separately operated, with at least one controller, at resonant frequencies matching heating requirements of the structure to heat the structure.

The scope of the present disclosure is defined solely by the appended claims and is not affected by the statements within this summary.

BRIEF DESCRIPTION OF THE DRAWINGS

The disclosure can be better understood with reference to the following drawings and description. The components in the figures are not necessarily to scale, emphasis instead being placed upon illustrating the principles of the disclosure.

DETAILED DESCRIPTION

Figure 1:
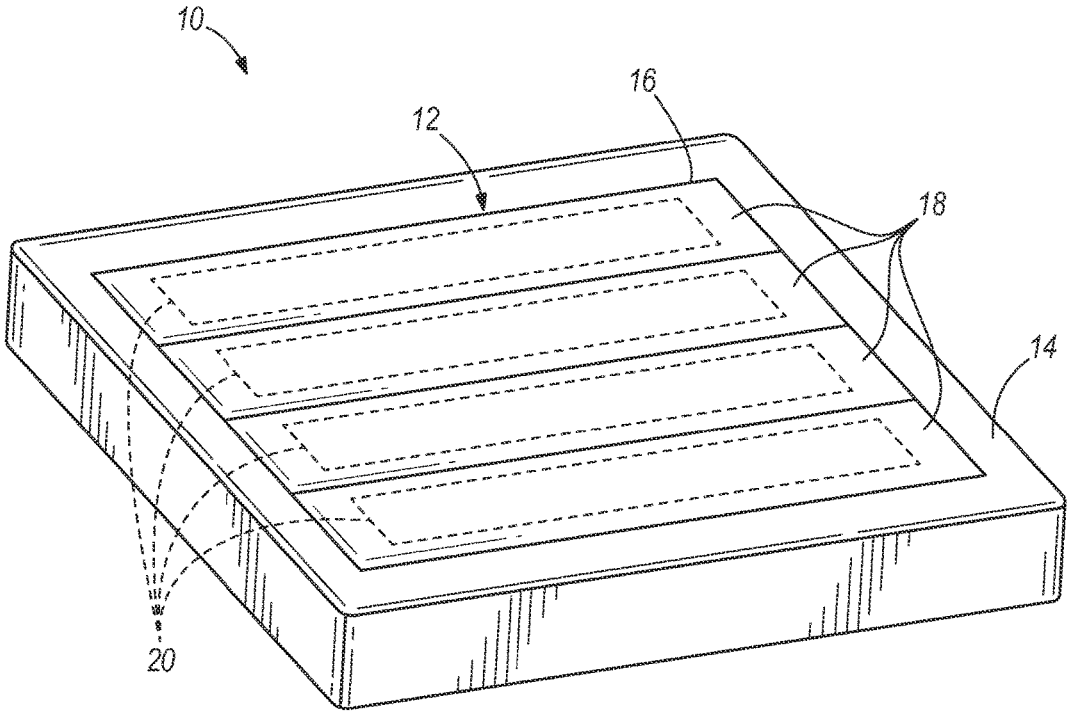
FIG. 1 illustrates a perspective view of a heating system.

FIG. 1 illustrates a perspective view of a heating system 10. The heating system 10 includes a heating apparatus 12 which is disposed in a position to heat a structure 14 such as against, adjacent, or near the structure. The heating apparatus 12 includes a housing member 16 having separate panels 18 with a separate circuit device 20 disposed in each separate panel 18 of the housing member 16. The housing member 16 is embodied as a blanket. The blanket is made of silicone or other flexible material that is compatible with 350 F operating temperatures, is flexible having a flexibility of minimum radius of 1 inch, and is lightweight weighing less than 3 lbs./sq. ft. (heavier blankets can be used but with more difficulty). In other embodiments, the blanket may be made of varying materials, may have varying levels of flexibility, and may weigh varying amounts. In still other embodiments, the housing member 16 can include varying types of housing members for holding a varying number of circuit devices in varying arrangements and configurations. The structure 14 includes a thermoplastic being consolidated or molded to an aircraft. In other embodiments, the structure 14 may vary.

Figure 2:
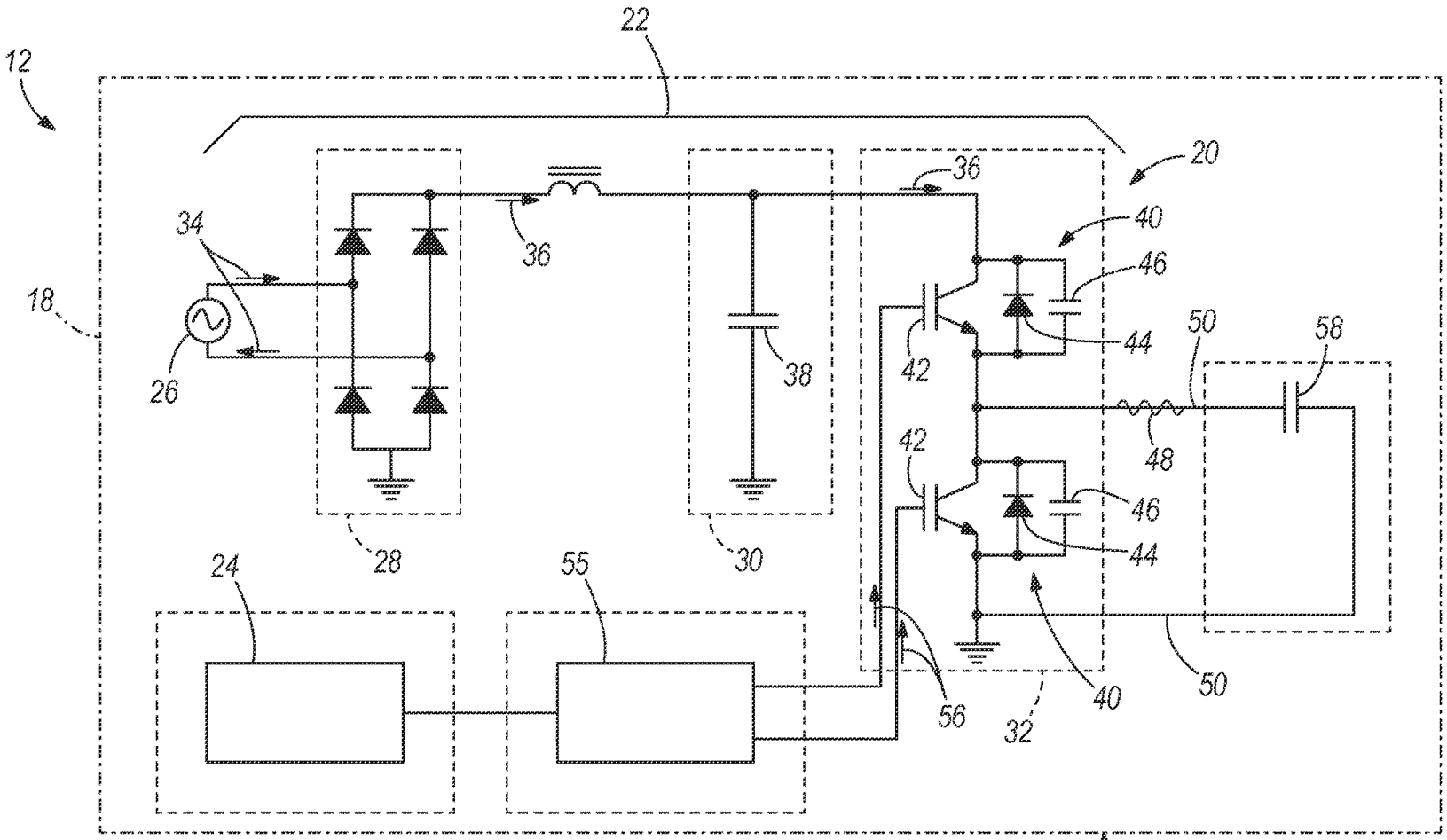
FIG. 2 illustrates a block diagram of a circuit device of one panel of a housing member of the heating system illustrated in the embodiment of FIG. 1.

FIG. 2 illustrates a block diagram of one of the separate circuit devices 20 of one of the panels 18 of the housing member 16 illustrated in the embodiment of FIG. 1. All of the separate circuit devices 20 of FIG. 1 may have the same configuration as shown in FIG. 2 with the separate circuit device 20 providing heating throughout the associated panel 18. Each separate circuit device 20 may fit within a three inch by six inch area. In other embodiments, one or more of the separate circuit devices 20 of FIG. 1 may vary in size, configuration, orientation, or capabilities. The separate circuit device 20 includes a resonant frequency power source 22 attached to the panel 18 of the housing member 16. The resonant frequency power source 22 may be positioned about the perimeter of the housing member 16. A controller 24 is configured to operate the resonant frequency power source 22 at a resonant frequency to match heating requirements of the structure 14 shown in FIG. 1. The heating requirements of the structure 14 may vary depending on the amount of heating the particular structure 14 requires. The resonant frequency may vary between 100 kHz to 2 MHz. In other embodiments, the resonant frequency may vary outside the 100 kHz to 2 MHz range. In one embodiment, each of the separate circuit devices 20 of FIG. 1 may have their own controller 24. In another embodiment, one controller 24, or in other embodiments any number of controllers 24, may be used to separately control the resonant frequency power sources 22 of the panels 18 of the housing member 16.

The resonant frequency power source 22 includes an alternating current input member 26, a rectifier 28, a direct current filter 30, and an inverter 32. The alternating current input member 26, which may be wall-powered, provides an alternating current input 34 to the rectifier 28. In one embodiment, the alternating current input 34 may be in a range of 1 to 20 amperes. In other embodiments, the alternating current input 34 may vary. The rectifier 28 converts the alternating current input 34 provided by the alternating current input member 26 to a direct current voltage 36 which charges a capacitor 38 of the direct current filter 30. The direct current voltage 36 may be 100 volts or less. In another embodiment, the direct current voltage 36 may be 60 volts or less. In other embodiments, the direct current voltage 36 may vary.

In the embodiment shown in FIG. 2, capacitor 38 of the direct current filter 30 supplies the direct current voltage 36 to the inverter 32. The inverter 32 includes a plurality of transistors 40 each having a switch 42, a diode 44, and a capacitor 46. The plurality of transistors 40 are configured to separately open and close their respective switches 42 to provide a varying voltage waveform 48, using the direct current voltage 36, through connected susceptor members 50 to heat the structure 14 shown in FIG. 1. The susceptor member 50 may be distributed around or throughout the panel 18 of the housing member 16 in order to obtain comprehensive and uniform heating. The plurality of transistors 40 includes metal-on-silicone-field-effect transistors with the electrical characteristics of the transistors 40 selected to match heating requirements of the structure. In other embodiments, the transistors may vary in type, electrical characteristics, effect, configuration, orientation, and number to meet the heating requirements needed.

Figure 3:
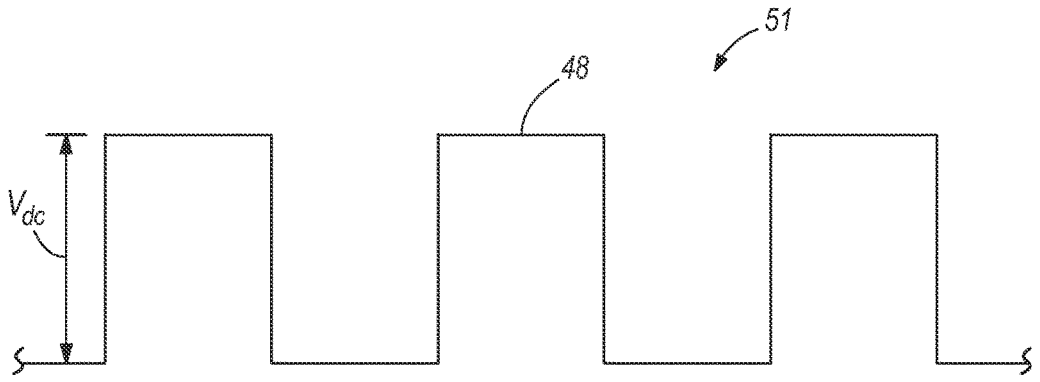
FIG. 3 illustrates a voltage graph illustrating a varying voltage waveform provided by a plurality of transistors of the heating system of the embodiment of FIG. 2.

FIG. 3 illustrates a voltage graph 51 illustrating the varying voltage waveform 48 provided by the plurality of transistors 40 of the embodiment of FIG. 2. The varying voltage waveform 48 is in a range of 0 V to 100 V. In other embodiments, the varying voltage waveform 48 may vary across any suitable voltage range.

Figure 4:
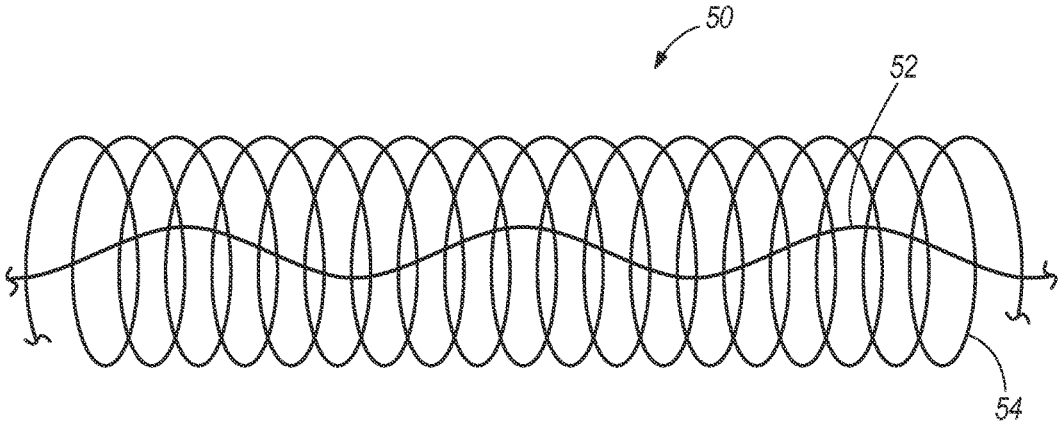
FIG. 4 illustrates a perspective view of a susceptor member of the heating system of the embodiment of FIG. 2.

FIG. 4 illustrates a perspective view of one of the susceptor members 50 of the embodiment of FIG. 2. Each of the susceptor members 50 may be identical. The susceptor member 50 includes an electrical wire 52 surrounded by a coil 54. The coil 54, which is made of electrically conducting ferromagnetic material, uses the thermostatic property of the Curie effect to control a temperature of the susceptor member 50 to meet the heating requirements of the structure 14 of FIG. 1. The impedance of the coil 54 varies with temperature and current level, which may make circuit matching difficult for conventional power supplies. The electrical wire 52 may be made of copper and the coil 54 may be made of alloy 32. In other embodiments, the electrical wire 52 and the coil 54 may be made of varying materials. In still additional embodiments, the susceptor members 50 may vary in material, configuration, orientation, and size. The inductance of the coil 54 depends on temperature and reaches a minimum as the Curie temperature is approached. This changes the resonant frequency and provides a means for monitoring temperature without thermocouples. Calibrating this temperature dependent resonant frequency and incorporating in a table for the particular susceptor provides the temperature during operation. Although the susceptors are fabricated out of a common alloy, slight differences in composition and lay of the coil 54 will result in different inductances. Using the calibration process described above, these individual differences can be accommodated to provide a learn and adapt capability.

As shown in FIG. 2, the controller 24 is electronically connected to a gate driver 55 which is electronically connected to the inverter 32 for controlling the resonant frequency power source 22 of the panel 18 of the housing member 16. Each panel 18 of the housing member 16 of FIG. 1 may have its own controller 24 and gate driver 55 to control the resonant frequency power source 22 of the panel 18. In other embodiments, any number of separate or shared controllers 24 and gate drivers 55 may be used to control the resonant frequency power source 22 of the separate panels 18. The controller 24 may include a micro-controller which is an 80 MHz 8-core CPU. In other embodiments, the controller 24 may vary in type and configuration. The controller 24 controls the gate driver 55 to send open and close voltage signals 56 to the inverter 32 to produce the desired voltage waveform 48 by opening and closing the switches 42 of the transistors 40 at the resonant frequency, with the desired voltage waveform 48 being sent through the susceptor members 50 to control the temperature of the susceptor members 50 due to the thermostatic property of the Curie effect of the susceptor members 50 in order to heat the structure 14 shown in FIG. 1 as needed. The resonant frequency may be in a range of 100 kHz to 1-2 MHz. In other embodiments, the resonant frequency may vary outside of the 100 kHz to 2 MHz range. By monitoring the resonant frequency of the susceptor circuit and controlling the frequency of the applied power using the disclosed heating system 10 it is possible to adjust heating as required to enact complex heating time histories, e.g., heat-up ramp rates, hold-conditions, and cool-down ramp rates. The controllers 24 may provide for the storage of complex switching profiles that can be stored on up to 32 Gb of disk space—this may include heat-up ramp rates, hold-conditions, and cool-down ramp rates.

Depending on the material properties and geometry of the susceptor members 50, a range of drive frequencies may be required to efficiently power the heating apparatus 12. Due to the controller 24 and gate driver 55 controlling the switching rate of the inverter 32, the drive frequency may be continuously adjusted up to a practical limit of approximately 1 to 2 MHz, which can be difficult to do with conventional power supplies. In other embodiments, the drive frequency may be continuously adjusted to varying amounts. In other embodiments, the drive frequency may be controlled based on feedback from input current, heating apparatus temperature, or housing member temperature to optimize performance.

A tuning capacitor 58 is attached to the susceptor members 50 to provide tuning capacitance for the voltage waveform 48 sent through the susceptor members 50. In other embodiments, a tuning capacitor may be attached to varying portions of the resonant frequency power source 22 or may not be used at all. The value of the tuning capacitor 58 is selected to match the room temperature inductance of the coil 54 and provide a resonant frequency in the desired range. The desired frequency range is determined by the skin depth in the susceptor material. Accurate temperature control of each susceptor/power supply combination is maintained by adjusting the frequency to match resonance for maximum heating or moving off resonance if less heating is required. As the Curie temperature is approached, the skin depth increases abruptly, setting an upper limit to the temperature. The capability to adjust heating by moving on and off resonance augments the thermostatic behavior of the Curie effect.

Figure 5:
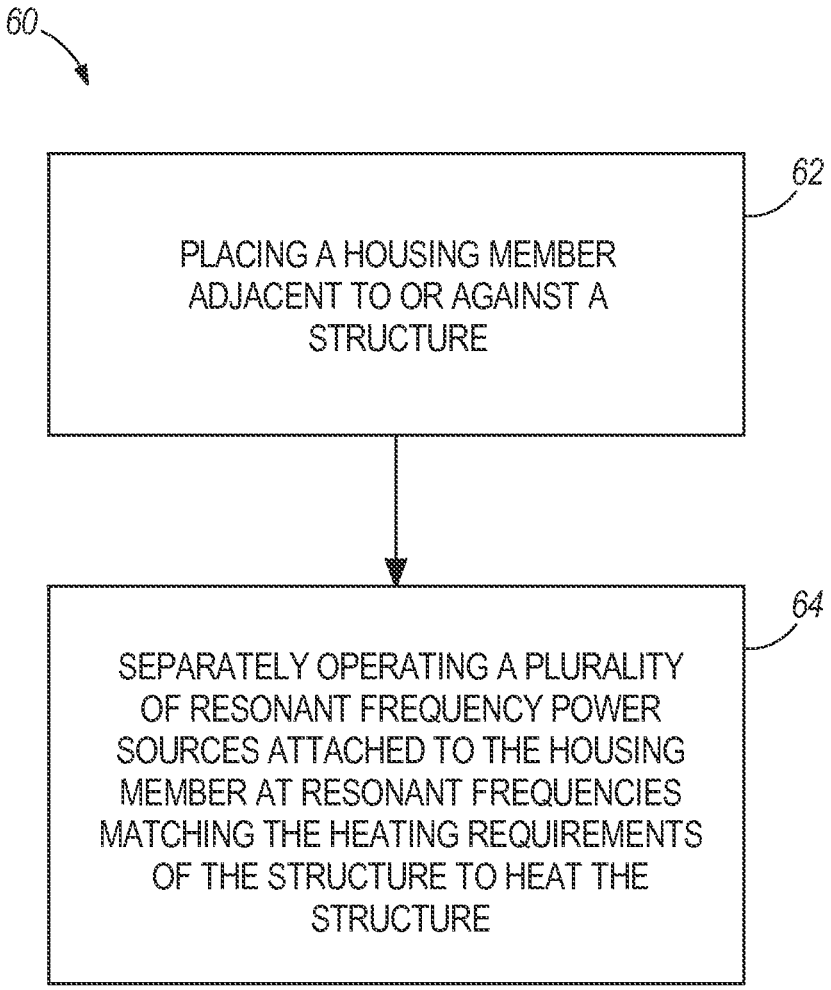
FIG. 5 is a flowchart illustrating one embodiment of a method for heating a structure.

FIG. 5 is a flowchart illustrating one embodiment of a method 60 for heating a structure (14). The method 60 may utilize any of the embodiments disclosed in the instant disclosure. In step 62, a housing member (16) is placed in a position to heat a structure (14) such as against, adjacent, or near the structure (14). In one embodiment, the housing member (16) is embodied as a blanket and the structure includes an aircraft or a thermoplastic. In another embodiment, the housing member (16) and the structure (14) may vary. In step 64, a plurality of resonant frequency power sources (22) attached to the housing member (16) are separately operated, with at least one controller (24), at resonant frequencies matching the heating requirements of the structure (14) in order to heat the structure (14). The heating of the structure (14) may include a consolidation process or a molding process, such as consolidating or molding a thermoplastic to an aircraft. The housing member (16) may be divided into panels (18), and each of the plurality of resonant frequency power sources (22) may be associated with a separate panel (18). In other embodiments, the plurality of resonant frequency power sources (22) may vary in configuration relative to the panels (18) of the housing member (16).

In one embodiment, step 64 may further include applying direct current voltage (36) to switching circuits (20), and switching the switching circuits (20) at the resonant frequencies matching the heating requirements of the structure (14) in order to heat the structure (14). Step 64 may further include converting alternating currents (34) to direct current voltages (36), charging capacitors (38) with the direct current voltages (36), and applying the direct current voltages (36) to a plurality of transistors (40) each having switches (42) which separately open and close to provide varying voltage waveforms (48) which match the heating requirements of the structure (14) in order to heat the structure (14). Step 64 may additionally include sending voltages (48) through a plurality of susceptor members (50), made of electrically conducting ferromagnetic material and attached to the housing member (16), at the resonant frequencies to control temperatures of the susceptor members (50) due to thermostatic properties of Curie effects of the susceptor members (50) matching the heating requirements of the structure (14) in order to heat the structure (14). In other embodiments, one or more steps of the method 60 may be modified in substance or order, not followed, or one or more additional steps may be followed.

One or more embodiments of the disclosure may reduce one or more issues of one or more of the existing heating devices. For instance, one or more embodiments of the disclosure may have one or more of the following advantages: allow for a large structure area to be efficiently heated; allow for a flexible and lightweight heating apparatus suitable for the application at hand which may be used in a portable application, a repair application in the field on a composite structure or another type of structure, or another application; provide heating of the structure with a transistor-based heating apparatus which uses a low to moderate direct current voltage without cumbersome cabling; allow for microprocessor control of the heating apparatus to provide the frequency agility needed to match temperature-dependent loads of the structure; and provide control of a resonant frequency switching power supply by selecting a susceptor member alloy for a given thermoplastic composite system and providing a self-adapting control program for this alloy which provides extremely accurate temperature control and uniformity to within a few degrees throughout multiple heating zones with independent control of each heating zone.

One or more embodiments of the disclosure may additionally have one or more of the following advantages: provide an inherently robust heating apparatus which does not rely on thermal over-shoot compensation schemes instead utilizing a self-regulating system which does not require placement of thermocouples or close process monitoring to ensure adequate thermal cycles; provide a compact, lightweight, low-voltage power supply integrated into the housing member using alternating current wall power input without personnel hazard due to the low-voltage; maintain a real-time match of the power supply to the varying load of the structure; provide uniform heating of the structure using a distributed power approach; provide for the storage of complex switching profiles using the controllers that can be stored on up to 32 Gb of disk space—this may include heat-up ramp rates, hold-conditions, and cool-down ramp rates; provide for learn and adapt capability for individual susceptor member coil inductor configurations; allow the circuit to incorporate feedback from heating apparatus input for better power and thermal control; provide power monitoring on input and on delivered power to allow precise heat control; and exploit the distributed, individually-adjustable power supply module architecture to apply power only where needed in the individual panels of the heating apparatus to maintain the desired temperature profile in the structure.

The Abstract is provided to allow the reader to quickly ascertain the nature of the technical disclosure. It is submitted with the understanding that it will not be used to interpret or limit the scope or meaning of the claims. In addition, in the foregoing Detailed Description, it can be seen that various features are grouped together in various embodiments for the purpose of streamlining the disclosure. This method of disclosure is not to be interpreted as reflecting an intention that the claimed embodiments require more features than are expressly recited in each claim. Rather, as the following claims reflect, inventive subject matter lies in less than all features of a single disclosed embodiment. Thus the following claims are hereby incorporated into the Detailed Description, with each claim standing on its own as a separately claimed subject matter.

While particular aspects of the present subject matter described herein have been shown and described, it will be apparent to those skilled in the art that, based upon the teachings herein, changes and modifications may be made without departing from the subject matter described herein and its broader aspects and, therefore, the appended claims are to encompass within their scope all such changes and modifications as are within the true spirit and scope of the subject matter described herein. Furthermore, it is to be understood that the disclosure is defined by the appended claims. Accordingly, the disclosure is not to be restricted except in light of the appended claims and their equivalents.

The invention claimed is:

1. A heating apparatus configured to heat a structure, the heating apparatus comprising:

a housing member;

a plurality of heating elements disposed within the housing member;

a plurality of resonant frequency power sources attached to the housing member and coupled with the plurality of heating elements; and at least one controller configured to:

determine, based on received temperature information associated with the plurality of heating elements, a plurality of resonant frequencies corresponding to the plurality of heating elements; and dynamically control, for each of the plurality of resonant frequency power sources, a corresponding drive frequency on and off a respective resonant frequency of the plurality of resonant frequencies to thereby meet a desired temperature profile across the structure.

2. The heating apparatus of claim 1 wherein the housing member comprises a blanket.

3. The heating apparatus of claim 1 wherein the plurality of resonant frequency power sources each comprise: an alternating current input member; a rectifier configured to convert alternating current provided by the alternating current input member to a direct current voltage; a direct current filter; and an inverter.

4. The heating apparatus of claim 3 wherein the direct current filter comprises a capacitor that is charged by a direct current voltage provided by the rectifier.

5. The heating apparatus of claim 3 wherein the inverter comprises a plurality of transistors each having a switch, wherein the plurality of transistors are configured to separately open and close their respective switches to provide a varying voltage waveform using a direct current voltage.

6. The heating apparatus of claim 3 further comprising at least one gate driver member, wherein the at least one controller controls the at least one gate driver member to send open and close voltage signals to the inverter according to the corresponding drive frequency.

7. The heating apparatus of claim 1 wherein the plurality of heating elements comprises a plurality of susceptor members, the plurality of susceptor members comprising electrically conducting ferromagnetic material connected to the plurality of resonant frequency power sources, wherein each of the resonant frequency power sources is configured to send, responsive to instructions from the at least one controller, voltage waveforms across one or more associated susceptor members at a respective resonant frequency to control temperatures of the one or more associated susceptor members based on thermostatic properties of Curie effects of the one or more associated susceptor members.

8. The heating apparatus of claim 1 further comprising a tuning capacitor connected to at least one of the plurality of resonant frequency power sources.

9. A heating system comprising:

a structure to be heated; and a heating apparatus disposed to heat the structure, the heating apparatus comprising:

a housing member;

a plurality of heating elements disposed within the housing member;

a plurality of resonant frequency power sources attached to the housing member and coupled with the plurality of heating elements; and a plurality of associated controllers configured to:

determine, based on received temperature information associated with the plurality of heating elements, a plurality of resonant frequencies corresponding to the plurality of heating elements; and dynamically control, for each of the plurality of resonant frequency power sources, a corresponding drive frequency on and off a respective resonant frequency of the plurality of resonant frequencies to thereby meet a desired temperature profile across the structure.

10. The heating system of claim 9 wherein the housing member comprises a blanket and the structure comprises an aircraft or a thermoplastic.

11. The heating system of claim 9 wherein the plurality of resonant frequency power sources each comprise: an alternating current input member; a rectifier configured to convert alternating current provided by the alternating current input member to a direct current voltage; a direct current filter; and an inverter.

12. The heating system of claim 11 wherein the direct current filter comprises a capacitor configured to be charged by a direct current voltage provided by the rectifier.

13. The heating system of claim 11 wherein the inverter comprises a plurality of transistors each having a switch, wherein the plurality of transistors are configured to separately open and close their respective switches to provide a varying voltage waveform using a direct current voltage.

14. The heating system of claim 11 further comprising a plurality of gate driver members, wherein the plurality of associated controllers separately control the plurality of gate driver members to send open and close voltage signals to the inverter of the associated resonant frequency power source according to the corresponding drive frequency.

15. The heating system of claim 9 wherein the plurality of heating elements further comprises a plurality of susceptor members, the plurality of susceptor members comprising electrically conducting ferromagnetic material connected to the plurality of resonant frequency power sources, wherein each of the plurality of resonance frequency power sources is configured to send, responsive to instructions from an associated controller, voltage waveforms across one or more associated susceptor members at a respective resonant frequency to control a temperature of the one or more associated susceptor members based on a thermostatic property of a Curie effect of the one or more associated susceptor members.

16. The heating system of claim 9 wherein the heating apparatus further comprises a plurality of tuning capacitors connected to the plurality of resonant frequency power sources.

17. The heating apparatus of claim 1, wherein each of the plurality of resonant frequency power sources is coupled with a respective tuning capacitor disposed in series with the respective one or more of the plurality of heating elements.

18. The heating apparatus of claim 17, wherein each tuning capacitor is selected such that the impedance of the tuning capacitor matches the impedance of the corresponding one or more coupled heating elements at a predetermined temperature.

19. The heating apparatus of claim 18, wherein the predetermined temperature is a room temperature.

20. The heating apparatus of claim 1, wherein the received temperature information comprises heating apparatus temperature information.

21. The heating apparatus of claim 1, wherein the received temperature information comprises housing member temperature information.

22. The heating apparatus of claim 1, wherein determining a plurality of resonant frequencies corresponding to the plurality of heating elements comprises accessing a predefined calibration table associating temperature values with resonant frequency values.

23. The heating apparatus of claim 22, wherein each heating element of the plurality of heating elements is associated with a respective predefined calibration table associating temperature values with resonant frequency values of the heating element.

24. The heating apparatus of claim 1, wherein dynamically controlling a corresponding drive frequency on and off a respective resonant frequency is performed according to a predefined complex switching profile including one or more of: heat-up ramp rates, hold conditions, and cool-down ramp rates.

* * * * *